United States Patent [19]

Krisko et al.

[11] 4,090,434

[45] May 23, 1978

[54] VARIABLE INDUCTION APPARATUS WITH A PRIMARY FLUID FLOW CONTROLLED INDUCTION DAMPER

[75] Inventors: Michael L. Krisko, Danbury; Donald R. Pare, Forestville, both of Conn.

[73] Assignee: Connor Engineering & Manufacturing, Inc., Danbury, Conn.

[21] Appl. No.: 774,776

[22] Filed: Mar. 7, 1977

[51] Int. Cl.[2] ..... F24F 11/02

[52] U.S. Cl. ..... 98/38 E; 236/13; 137/604

[58] Field of Search ..... 98/40 D, 38 E, 38 D, 98/38 R; 137/604; 417/190; 236/13, 49

[56] References Cited

U.S. PATENT DOCUMENTS

| | | | |
|---|---|---|---|
| 3,611,908 | 10/1971 | Spoormaker | 98/40 D |
| 3,883,071 | 5/1975 | Meckler | 236/13 X |
| 3,989,187 | 11/1976 | Osheroff | 236/13 |

*Primary Examiner*—William E. Wayner
*Attorney, Agent, or Firm*—Curtis Ailes

[57] ABSTRACT

A primary fluid nozzle induces secondary fluid flow through an induction port opening. A damper valve element is provided at the induction port and is constantly biased open. A variable flow fluid inlet is positioned to one side of the nozzle orifice and arranged to direct fluid against the induction port damper tending to close the damper depending upon the flow of fluid through the variable flow fluid inlet. Thus, when primary fluid flow increases through the variable flow inlet, the secondary fluid damper tends to be closed, reducing secondary fluid flow.

19 Claims, 8 Drawing Figures

FIG. 3
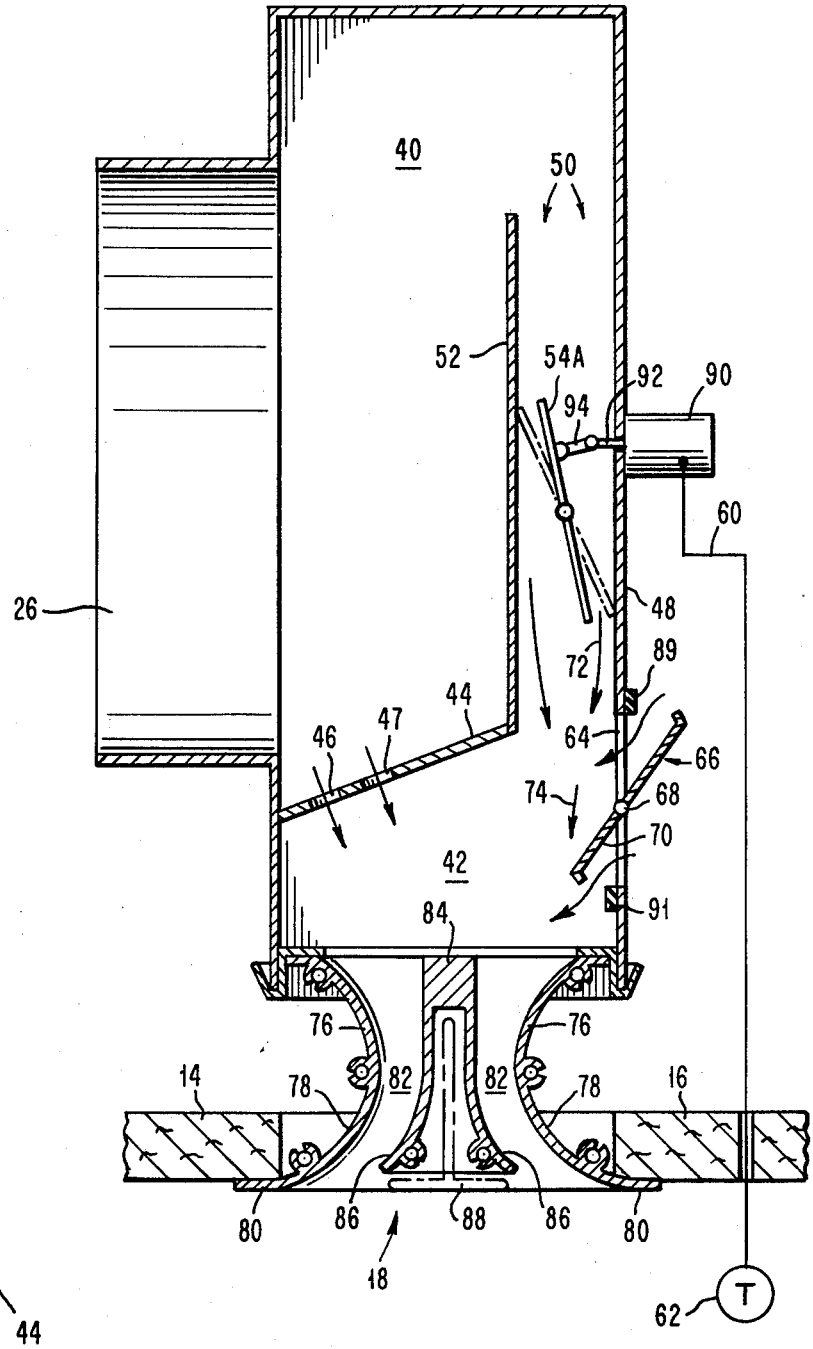
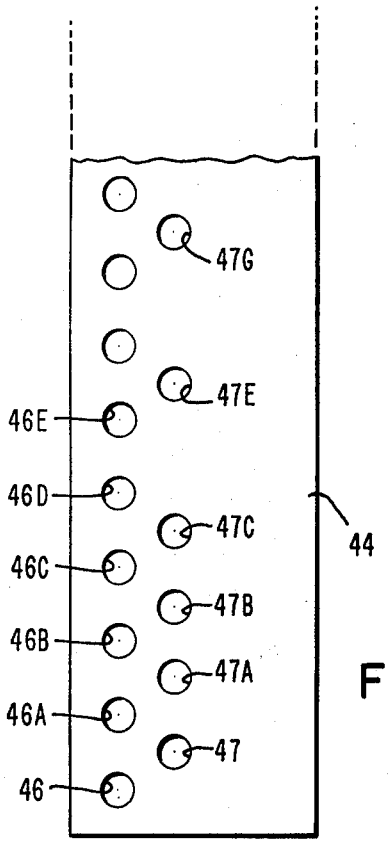
FIG. 2

VARIABLE INDUCTION APPARATUS WITH A PRIMARY FLUID FLOW CONTROLLED INDUCTION DAMPER

This invention relates to fluid flow control apparatus for a compressible fluid such as air, and the invention is particularly useful in an air conditioning system for mixing primary fluid which may be conditioned with secondary fluid which may be unconditioned by induced flow.

Controllable induction apparatus for compressible fluids such as air has long been recognized as very useful. Such apparatus is particularly useful as a part of a terminal unit in an individual room within an air conditioned building for the purpose of mixing conditioned air with the air that is in the room enclosure. In buildings having so-called "dropped" ceilings, the air conditioning ducts and the air conditioning terminal units, usually including air diffusers, may be housed in and above the dropped ceiling. In such an installation, it is desirable to provide induction apparatus as a part of the terminal unit in order to make use of the heat generated by the electric lights and other heat sources in the room to help supply the heating needs of the room, or to temper the cooling air supplied by the air conditioner to the room.

Prior terminal units for air conditioning systems which provide induction have usually included positively driven controlled dampers for both the primary conditioned air and the secondary induced air. Such dampers are commonly operated in unison and in opposite directions, so that as the primary air flow is decreased, the induced air flow is increased.

Generally, in such air induction apparatus, it is desirable to provide for a substantially constant total discharge volume of air in order to provide for proper operation of the air diffuser associated with the unit, or for proper diffusion of the air, with or without a specialized air diffuser unit. For this purpose, as conditions vary, particularly heating or cooling requirements, it is desired to vary the ratio of primary conditioned air to secondary induced air in an inverse relationship. Thus, when additional heating or cooling from the primary air is required, primary air is increased and induced air is reduced. However, when heating or cooling requirements are more nearly satisfied, primary air flow is reduced, and secondary air flow is increased to maintain more nearly constant volume flow.

One of the best prior designs of induction apparatus for providing this inverse function between primary air and induced secondary air is illustrated in U.S. Pat. No. 3,611,908 issued Oct. 12, 1971 for Air Conditioning Terminal Units by Hendrick J. Spoormaker. In the induction apparatus of that patent, venturi nozzles are supplied with primary air and caused to induce secondary air flow through open side ports. When less secondary air is desired, and more primary air is desired, an auxiliary air volume control valve is opened for the primary air which bypasses the venturi nozzles, and thus causes a reduction in pressure of primary air supplied to the venturi nozzles, substantially reducing the volume of air flowing through the venturi nozzles and thus reducing the induced secondary air as the primary air is increased. That apparatus has proven to be very simple and very satisfactory. However, for satisfactory operation it has been found that such apparatus requires a minimum water gauge pressure of at least 1.5 inches in the primary air duct supplying the induction apparatus when maximum induction is desired.

It is one object of the present invention to provide a variable induction apparatus which is especially useful in air conditioning systems which is operable at a substantially reduced pressure and which thereby conserves energy and reduces system cost by permitting a reduction in fan size and horsepower, and by permitting the use of a low pressure supply duct system.

The prior art induction apparatus referred to above relies for its operation upon a drop in pressure in the primary fluid when the auxiliary control valve opens, thus reducing the pressure and the fluid velocity at the venturi orifices which induce the secondary flow. This drop in pressure is obtained by using a balancing damper, or some other constriction upstream in the primary duct. Since the pressure drop is not fully predictable because it depends greatly upon the upstream characteristics of the duct system, including the setting of a balancing damper, the variation in the primary and secondary air flows is not predictable and thus, the design requirements of the system are only approximately met.

It is another object of the present invention to overcome the above mentioned disadvantage of the prior induction apparatus by providing an improved induction apparatus which is efficiently operable at a constant controlled primary air supply pressure, and which does not require any variation in the primary air supply pressure for operation.

It is another object of the invention to provide a constant pressure induction apparatus which, by virtue of the constant pressure of operation, provides an absolutely predictable operation characteristic curve to provide the exact design requirements in terms of the relative inverse variations of primary and secondary air flow within relatively narrow predictable limits.

Another object of the present invention is to provide a high ratio of controlled change in the proportion of fluid induced by the induction apparatus at a constant low pressure of operation.

Another object of the invention is to provide an improved simple induction apparatus which is easily controllable to provide substantially no induction when that mode of operation is desired while requiring direct control of only the primary fluid flow.

Still another object of the invention is to provide an induction apparatus which is operable at a low static pressure of the primary fluid in the order of 0.5 inches (12.7mm.) water gauge.

Further objects and advantages of the invention will be apparent from the following description and the accompanying drawings.

In carrying out the invention there is provided an induction apparatus for a compressible fluid such as air as used in an air conditioning system and for mixing, by induced flow, primary fluid which may be conditioned with secondary fluid which may be unconditioned, comprising a housing having walls defining a compressible fluid inlet chamber and a separate compressible fluid outlet chamber and having a partition means between said chambers, said housing including means to connect said inlet chamber to a source of conditioned fluid and said housing also including an outlet to release fluid from said outlet chamber, said partition means including at least one constricted nozzle orifice for admitting compressible fluid from said inlet chamber to said outlet chamber, said partition means also including a variable flow fluid inlet positioned to one side of said nozzle orifice and adjacent to one outside wall of said housing, controllable means associated with said variable flow inlet for controllably varying the flow of primary fluid therethrough from said inlet chamber to said outlet chamber, an induction port opening in said wall of said housing in the portion thereof defining said outlet chamber, said induction port opening being arranged for communication with a source of secondary fluid, a damper valve element mounted within said induction port for closing said port and pivotally mounted to swing about an axis substantially perpendicular to the flow of fluid through said variable flow inlet, means for constantly biasing said induction port damper towards the open position, the pivotal mounting of said induction port damper being positioned so that the opening rotation of said induction port damper swings the downstream end of said damper into said outlet chamber of said housing and into the path of fluid from said variable flow inlet so that the flow of fluid from said variable flow inlet tends to close said damper, the opening and closing of said damper thus being controllable by the flow of fluid passing through said variable flow inlet to thereby control the volume of induced secondary fluid flow.

In the accompanying drawings:

FIG. 2 is a detail plan view of a perforated interior plate forming induction nozzles within the induction apparatus of FIG. 1.

FIG. 3 illustrates a further modification of the invention in which a pivoted damper is employed as the controllable means for the variable flow inlet.

Figure 6:
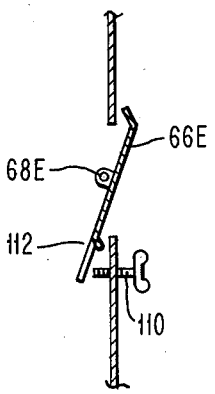
Figure 7:
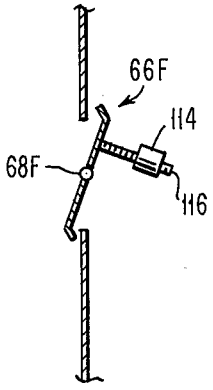
Figure 8:
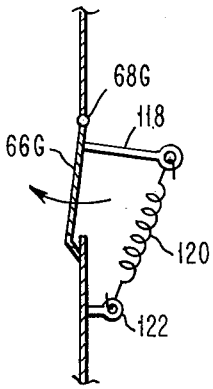

FIGS. 6, 7, and 8 illustrate various modifications of the induction port damper valve element of the invention.

Figure 1:
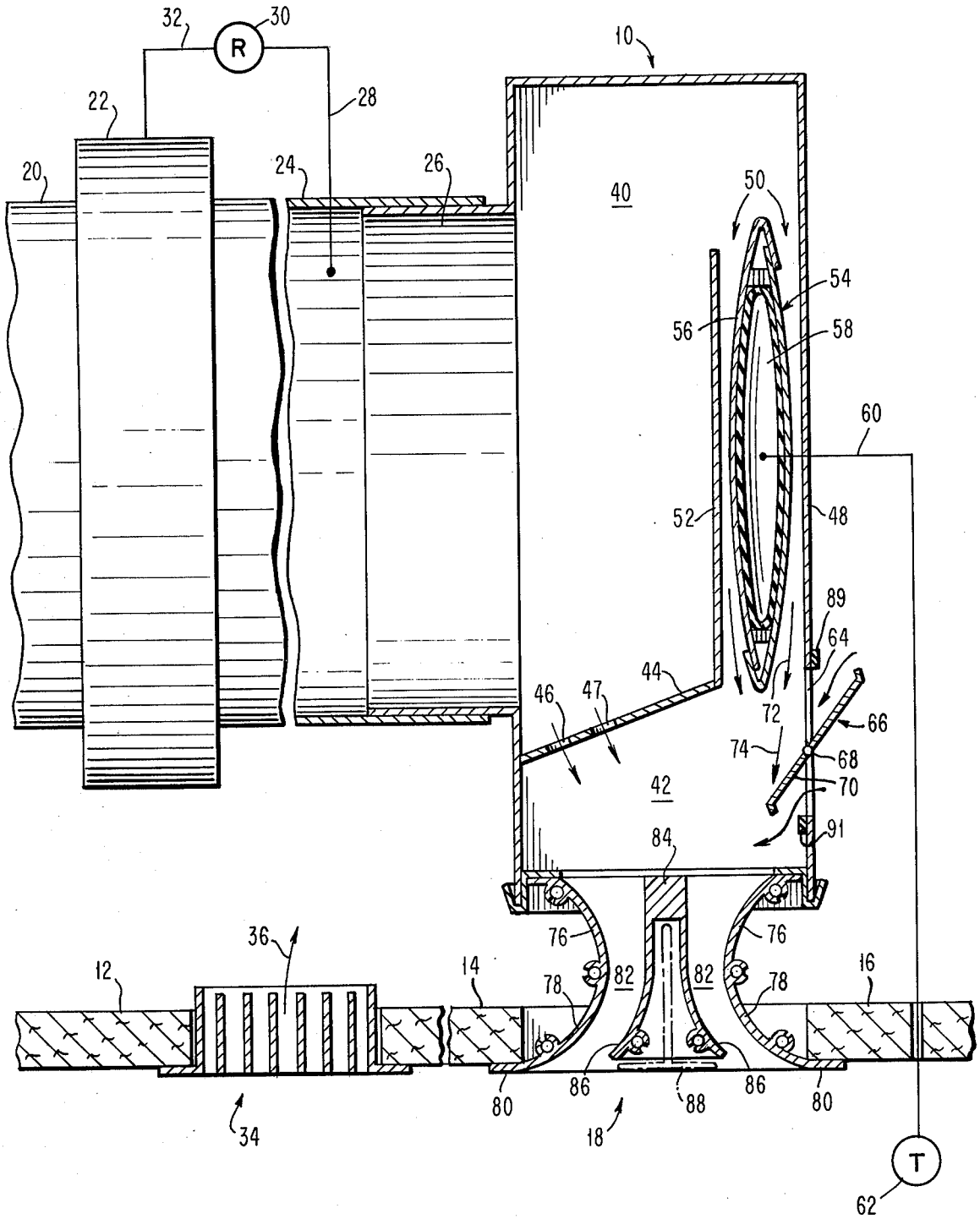
FIG. 1 is a sectional side view taken at a narrow side of a variable induction apparatus in accordance with the present invention combined with a so-called linear diffuser and shown installed in the ceiling of a room.

Referring more particularly to FIG. 1, there is shown a variable induction apparatus generally indicated at 10 which is installed in the space above the dropped ceiling of a room within a building. The dropped ceiling panels are indicated at 12, 14, and 16. The lower end of the housing of the induction apparatus 10 includes an air diffuser which is generally indicated at 18. The diffuser which is shown in the drawing is referred to as a "double-throw" type, because it provides two outlet passages for the air which are intended to send the air out in generally horizontal directions near the ceiling in order to provide for distribution of the air over the area of the room.

Conditioned primary air (which is usually either heated or cooled) is supplied from a primary conditioned air source through a supply duct indicated at 20. The primary air source may operate at a variable pressure, and may provide air at varying volumes. However, in accordance with the preferred form of the present invention, the delivery of air to the variable induction apparatus 10 is precisely regulated in order to provide a substantially constant low pressure value despite variable volume requirements for conditioned air. This is accomplished by means of a variable volume damper indicated at 22, which is connected and arranged to control the flow of air from the supply duct 20 through an associated branch duct 24, and through an inlet connection 26 of the induction apparatus 10. The pressure within the duct 24, and thus within the inlet portion of the induction apparatus 10 is preferably maintained at about 0.5 inches (12.7mm.) water gauge by means of a pneumatic pressure regulator control which is schematically shown as including a connection tube 28 and a pressure regulator device 30 which controls the operation of the variable volume damper 22 through a pneumatic connection 32. While not illustrated in detail, the variable volume damper 22 is preferably a pneumatically operated damper of the type disclosed in U.S. Pat. No. 3,011,518 issued on Dec. 5, 1961 to T. L. Day et al for a pneumatic damper. The showing of the damper 22 in FIG. 1 is schematic only, and the proportions are not necessarily correct for the aforementioned pneumatic damper of the prior patent.

In a dropped ceiling installation of the kind in which the present invention is intended to be employed most frequently, there is provided some means whereby air from the room is permitted to enter the space above the dropped ceiling, as represented by the ceiling tiles 12, 14, and 16. Such means may include an air return register 34 in the ceiling, permitting air to enter as indicated at 36. While not shown, passages may also be advantageously provided near ceiling light fixtures to permit air to circulate from the room into the space above the ceiling over the edges of or through the light fixtures. In either way, the air from the room which enters the space above the dropped ceiling may be referred to as "secondary" air which is not conditioned, and which is to be induced in the induction apparatus 10 by the primary air from the primary air source duct 20.

The induction apparatus 10 includes a housing having walls defining an inlet chamber 40, an outlet chamber 42, and a partition 44 between the chambers 40 and 42. The primary conditioned air enters the inlet chamber 40 through the inlet connection 26. The outlet chamber 42 includes an outlet to release the air from the outlet chamber. That outlet generally comprises the diffuser previously referred to generally at 18.

The partition 44 between the inlet chamber 40 and the outlet chamber 42 includes preferably a plurality of orifices indicated at 46 and 47 for admitting air from the inlet chamber 40 to the outlet chamber 42. As an extension of the partition 44, adjacent to the outside wall 48 of the housing there is provided a variable flow inlet generally indicated at 50. The inlet 50 is generally defined by an inside partition wall 52 extending upwardly for a substantial distance from the edge of the chamber partition 44. Thus, the inlet 50 is generally defined as the space between the inner wall 52 and the outer wall 48. A variable fluid flow device 54 is provided within that variable flow inlet. That device is preferably constructed in accordance with the teachings of the aforementioned U.S. Pat. No. 3,011,518. It generally consists of an expansible metal casing 56 which contains a bladder 58 of rubber or rubber-like flexible material. If the variable flow inlet 52-48 is to be closed, pneumatic control pressure is supplied to the interior of the bladder 58, causing the casing 56 to expand so as to partially or completely close the inlet. The device is shown in a partially expanded condition in the drawing. The pneumatic control pressure is preferably supplied through a control connection schematically indicated at 60 from a control thermostat located within the room enclosure as indicated schematically at 62. Just beneath the variable flow inlet 50 for primary fluid there is provided an induction port opening 64 in the wall 48. There is also provided a damper valve element 66 pivotally mounted at a pivot 68 for closing the port 64. The induction port damper 66 is constantly biased towards the open position. This bias may be provided in various ways. However, in the preferred embodiment illustrated in FIG. 1, the bias is accomplished by making the portion of the damper 66 above the pivot point 68 larger and heavier than the portion below the pivot point 68. The damper 66 is also formed in an "S" shape so that the upper portion always extends out beyond the pivot 68 to provide an opening turning gravity force, even in the fully closed position.

As shown in the drawing, the induction port damper 66 is pivotally mounted and arranged so that the lower end 70 of damper 66 swings into the outlet chamber 42 of the housing and into the path of fluid from the variable flow inlet 50. The flow of such fluid is schematically indicated by the arrows 72 and 74. Thus, the primary air flow through the variable flow inlet 50 tends to counterbalance the opening bias force upon the secondary fluid induction port damper element 66. In this manner, the opening and closing of the damper 66 is controlled by the flow of fluid passing through the variable flow inlet 50.

The diffuser portion 18 of the structure includes lower longitudinal side walls 76 which are flared inwardly, and which are joined to the lower corners of the portion of the housing defining the outlet chamber 42. These inwardly flared side walls extend downwardly to outwardly flared portions 78, and each terminates in an outwardly extending flange 80. The space between the two walls 76 is divided to define two diffuser discharge slots 82 by means of an inner wall member 84 which includes two downwardly and outwardly flared vanes 86. The entire combined structure including the diffuser 18 and the induction apparatus 10 may be positioned over a T-bar 88 which may constitute a part of the dropped ceiling structure. The ceiling panels 14 and 16 would normally be supported upon the horizontal flanges of the T-bar 88, in the absence of the diffuser and induction apparatus. However, in the presence of the apparatus, the edges of the ceiling panels 14 and 16 are supported upon the outwardly extending flanges 80 at the bottom edges of the diffuser side walls.

The mode of operation of the induction apparatus of FIG. 1 is generally as follows: with the variable flow inlet 50 open, for instance in the maximum open condition, the flow of air through that inlet, at 72 and 74 is strong enough to close and maintain the induction inlet damper 66 in the closed position, thus essentially preventing induction of secondary air. Under such circumstances, only primary conditioned air is supplied to the room through the diffuser 18 by a flow of air through the variable flow inlet 50 and through the nozzle openings 46 and 47 in the partition 44.

If less conditioning is called for, the room thermostat 62 detects that condition, and through the control connection 60 causes the expansion of the pneumatic flow control device 54, thus closing the variable flow inlet 50. Under these circumstances, the induction port damper 66, which is normally biased open, moves to the open position as illustrated in the drawing. While not shown, a stop is preferably provided to limit the movement of damper 66 in the opening direction to the maximum desired open position. Under these circumstances, a maximum of induction of secondary air occurs. This is accomplished by the action of the air through the primary nozzles 46 and 47 in the partition 44 which direct primary air down into the diffuser passages 82 and entrain and carry secondary air into those passages along with the primary air.

Employing the principles of the present invention, it has been found that even with only 0.5 inches (12.7mm.) water gauge of air pressure maintained in the inlet chamber 40, as much as a one to one ratio of induced air to primary air may be achieved when maximum induction is called for.

Depending upon the design and counterbalancing of the induction port damper 66, it is possible to provide either for a proportional opening operation, or for an "on-off" operation of the damper to control the amount of induction. With proportional operation, if the pneumatic valve element 54 is only partially expanded, to only partially close the variable flow inlet 50, then the damper 66 is only partially opened, and an intermediate flow of induced air is provided. Thus, a proportional operation of the device is possible. However, if the induction port damper 66 is provided with a weaker opening bias force, then the damper may operate in an "on-off" mode in which the damper remains closed while the variable flow inlet 50 is open, and as the variable flow inlet 50 is gradually closed, until, at a critical point, the force of the air flow at 74 is no longer sufficient to maintain the damper closed. At that point, the damper opens substantially fully providing for full induction. In both instances, when the variable flow inlet 50 is at least partially open, and the induction port damper 66 is at least partially open, a portion of the induction of secondary air occurs through entrainment of secondary air by primary air admitted through the variable fluid inlet 50.

At the upper and lower edges of the induction port opening 64 there are preferably provided cemented-on cushioning and sealing edge finishing devices 89 and 91 formed of a material such as vinyl or rubber, or a rubberlike cushioning material. This is for the purpose of providing a seal for the edges of the damper 66 when it closes, and more importantly for providing a cushion to reduce the metal-to-metal noise which otherwise might occur as the damper moves rapidly to a closed position. These devices 89 and 91 may be formed of extruded material, and may be cemented in place, if desired.

Many different arrangements of the nozzle orifices 46 and 47 in the partition 44 have been found to provide satisfactory results. However, preferably the partition is slanted at an angle of about 20° from the horizontal, as indicated in the drawing, so that the nozzles formed by the apertures 46 and 47 are aimed somewhat over towards the center of the outlet chamber 42. As illustrated in the drawing, the apertures 46 and 47 are crowded over towards the left lower wall of the housing, and are not particularly centered with respect to the outlet chamber 42. After substantial experimentation, it has been determined that this arrangement is very effective, even though the nozzles 46 and 47 do not appear to direct the air exactly in the direction of the discharge slots 82. Apparently there are various turbulence effects which enable the induction apparatus to operate efficiently with the offset nozzles.

Furthermore, the nozzle apertures 46 and 47, while illustrated as only one pair of nozzles in FIG. 1, are actually representative of two entire groups of nozzles arranged along the length of the partition plate 44.

FIG. 2 is a plan view of the aperture plate 44 illustrating the arrangement of apertures 46 and 47 and including related apertures 46A, 46B, etc. and 47A, 47B, etc. It will be seen from this drawing that the individual members of the two sets of apertures are staggered with respect to one another. That is, aperture 47 is located vertically in the drawing approximately midway between aperture 46 and aperture 46A etc. In a particular preferred physical embodiment, in accordance with FIG. 1, the dimension from the end of the plate 44 shown at the bottom of the drawing to the first aperture 46 is about ½ inch (12.7mm.), and the individual apertures 46, 46A, 46B in the first row are successively spaced apart by about 22/32 of an inch (18.25mm.) from center to center. A similar spacing is provided for the apertures 47, 47A, 47B etc. The dimension from the left edge of the plate 44 to the common center line of the apertures 46, 46A is about ½ inch (12.7mm.), and the dimension from the left edge to the common center line of the apertures 47, 47A is about 1-1/32 of an inch (26.2mm.).

As further illustrated in the drawing, after the first four apertures in the second row (apertures 47, 47A, 47B, and 47C) the spacing of the apertures in row 47 is doubled and the aperture which would have been 47D is omitted. This pattern is continued for the entire length of the plate 44 until the opposite terminal portion, where another group of four closely spaced apertures in the aperture 47 row is provided. In a preferred embodiment as shown, the entire length of the plate 44, and the entire device, is approximately 24 inches (609.6mm.). Each of the apertures is ⅜ of an inch (9.53mm.) in diameter.

It must be emphasized that this is only one illustrative embodiment of the invention, and that many different arrangements of nozzle apertures may be employed satisfactorily in carrying out the invention. Generally speaking, if larger apertures are employed, the number of apertures is reduced. Furthermore, the number and size and arrangement of the apertures may be varied in order to provide different desired operating characteristics.

FIG. 3 illustrates a modification of the invention of FIG. 1 in which the pneumatically expandible valve element 54 for the variable flow inlet 50 has been replaced by a pivotally mounted damper valve element 54A which is operated by the thermostat 62 through the pneumatic line 60 by means of a pneumatic actuator device 90 which is connected to the damper 54A through an operating rod 92 and a connecting rod 94.

All of the remaining features of this modification operate essentially the same as described above for the embodiment of FIG. 1. Thus when the variable flow inlet 50 valve 54A is open, as shown in FIG. 3, the primary air flow, as indicated at 72 and 74, tends to close the induction port inlet damper 66. Thus, the principle of operation of the induction port damper is exactly the same. While it is possible to employ the modification of FIG. 3, the expandible pneumatic valve 54 illustrated in FIG. 1 represents the preferred embodiment of the invention because it has been found that the flow of air around the pneumatically expandible valve element is less turbulent, and the control structure is somewhat simpler and more trouble-free.

Figure 4:
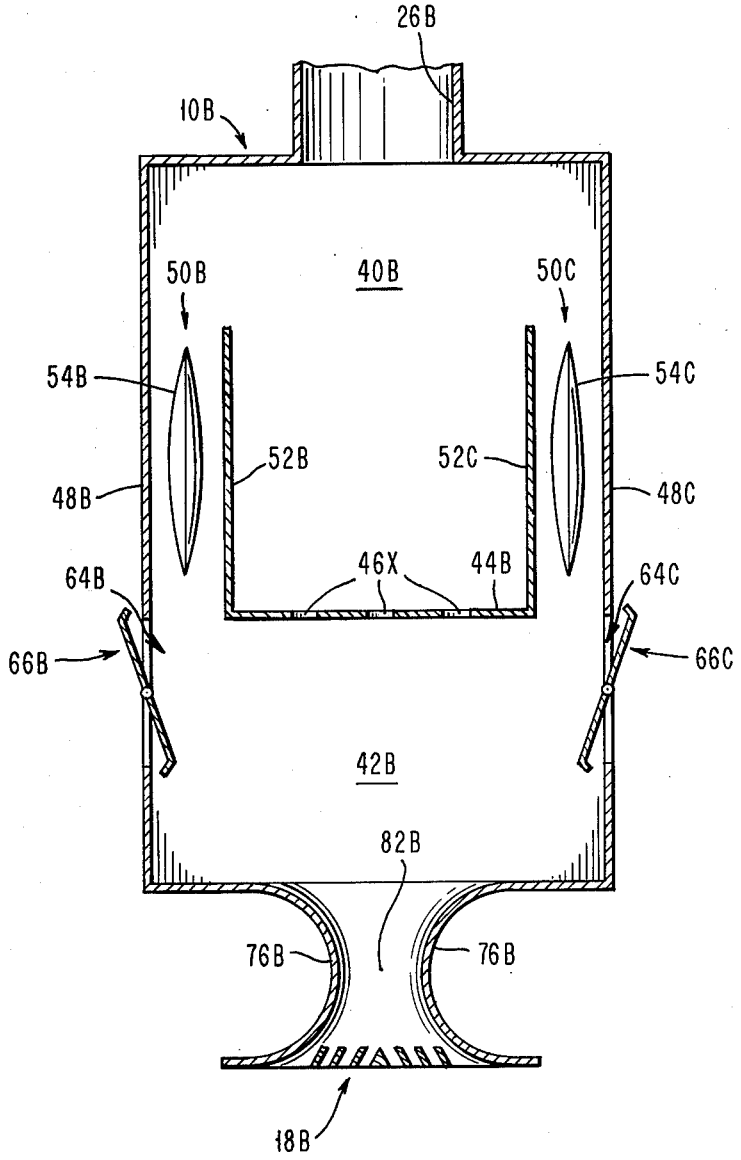
FIG. 4 illustrates a further modification of the invention employing plural secondary air induction ports.

FIG. 4 is a sectional side view corresponding to FIG. 1 and illustrating a modification of the invention in which two induction port openings 64B and 64C are provided with separate induction port damper valve elements 66B and 66C on opposite walls of the housing of a modified induction apparatus 10B. Above each induction port opening there is provided a separate variable flow fluid inlet 50B and 50C each having a separate controllable pneumatically expansible oval casing device 54B, 54C for controllably varying the flow of primary fluid through the variable flow inlets. Thus, the induction of secondary air through the induction port openings 64B and 64C by the primary air passing through nozzles 46X in the barrier 44B is controlled by the opening of the variable flow of fluid inlets by the devices 54B and 54C. This control is accomplished by the control of the induction port damper valve elements 66B and 66C by the control of the flow of fluid through the variable flow inlets 50B and 50C by the control elements 54B and 54C. The control elements 54B and 54C may preferably be connected to be controlled by a common thermostat.

As in the embodiment of FIG. 1, the outlet from the lower chamber 42B may be constricted, as at 82B by constricting lower walls 76B, and this structure may form a diffuser 18B. As previously explained in connection with FIG. 1 the constriction at 82B enhances the induction effect.

Figure 5:
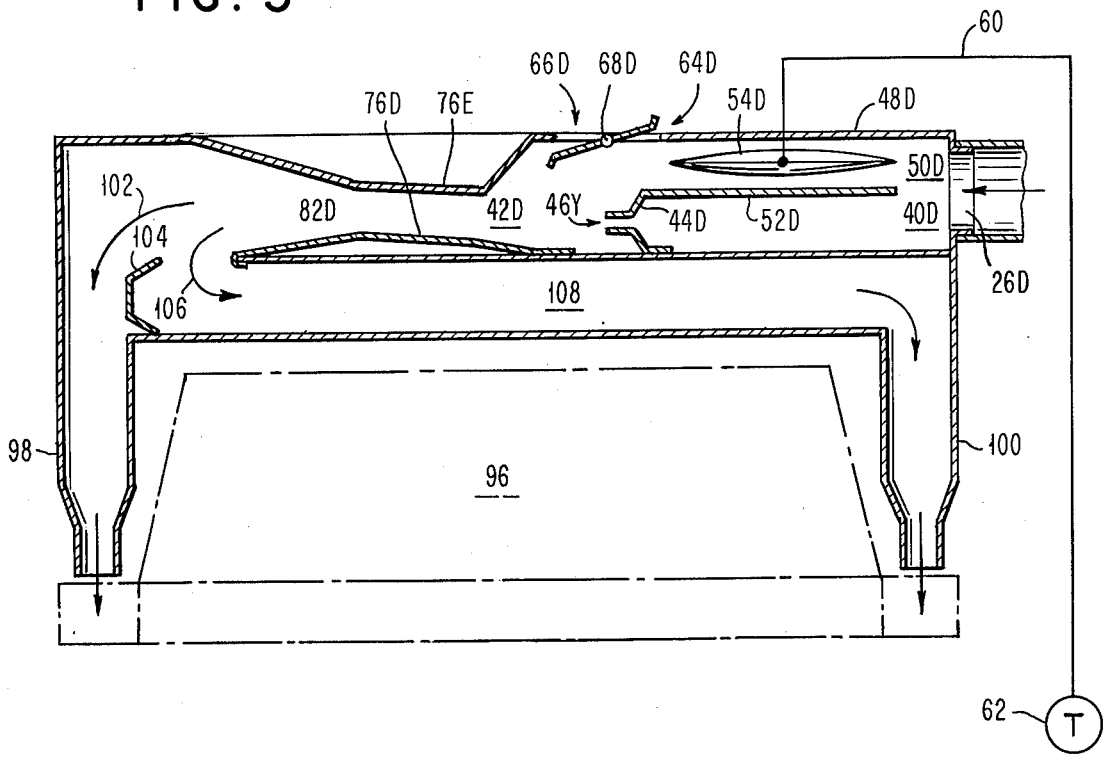
FIG. 5 illustrates a modified embodiment of the invention in which the flow of air in the induction apparatus is substantially horizontal, and in which the apparatus is conveniently combined with a so-called troffer type of diffuser.

FIG. 5 is a sectional side view of a modification of the invention in which the induction apparatus is combined with the structure of a troffer diffuser to conform with, and to be combined with, a troffer luminaire (ceiling lighting fixture). The luminaire lighting fixture is indicated in phantom at 96, and it is straddled by the combination induction apparatus and diffuser structure including downwardly extending diffuser outlet parts 98 and 100. The diffuser outlets 98 and 100 are fed from above by means of an induction apparatus in which all of the parts corresponding to those previously explained in connection with FIG. 1 have been labeled with corresponding part designations, but with the suffix letter "D" added. Thus, the primary air is supplied through an inlet 26D, preferably at a constant pressure, to an inlet chamber 40D, and from there through a slot-type of nozzle 46Y to the outlet chamber 42D. In this modification of the induction apparatus, the nozzle 46Y is formed as a slot constriction by metal members which define the slot in a typical nozzle configuration, rather than merely providing perforations in a plate as previously described in connection with FIG. 1. Again, a variable flow inlet 50D is provided which is controlled by an expandible pneumatic damper 54D in response to pneumatic signals conveyed through connection 60 from thermostat 62. The flow of primary fluid through the variable flow inlet 50D controls the operation of an induction port damper valve element 66D which is substantially similar to damper valve element 66 of FIG. 1, and which controls the opening of the induction port 64D. A downstream constriction 82D is defined as the outlet from the outlet chamber 42D by means of flow constricting walls 76D and 76E. This constriction, as in the embodiment of FIG. 1, enhances the induction of secondary air flow provided by the nozzle 46Y. From the constriction 82D, a portion of the air is supplied directly, as indicated at 102, to the diffuser outlet 98. Another portion of the air from 82D is deflected by a deflector member 104, as indicated at 106, to flow through a crossover passage 108 to the diffuser outlet member 100. Thus, the air supplied rom the induction apparatus is divided and delivered through the two different diffuser elements 98 and 100.

The embodiment of FIG. 5 illustrates the versatility of the invention by illustrating a number of separate modification features of the invention as follows:

The nozzles need not be provided by simple perforations in the partition between the inlet and the outlet chambers, but may be provided by a more conventional nozzle structure; the downstream constriction at the outlet of the outlet chamber need not be combined with a diffuser, but may be upstream from the diffuser itself; and the damper valve element for the induction port opening need not be arranged vertically in the closed position, but may be arranged horizontally in the closed position.

Referring in more detail to the last feature mentioned above, it is somewhat simpler with the horizontal induction port damper 66D of FIG. 5 to provide for a constant gravity opening bias by simply offsetting the pivot 68D. The initial opening bias in accordance with this arrangement is somewhat greater than the opening bias employing gravity with the vertically arranged damper valve elements illustrated in the prior figures. The offset of the pivot 68D of the induction port damper 66D has been exaggerated in the drawing in order to make the principle clearer.

FIG. 5 also illustrates a variation in the construction of the induction port damper 66D in which the figure-S shape is arranged so that the downstream tip of the damper is aimed into the stream of air from the variable flow inlet 50D. This arrangement is opposite to the arrangement of the damper 66 of FIG. 1. It has been found that this arrangement of the damper works well, especially in the horizontal configuration illustrated in FIG. 5. The air from the variable flow inlet 50D impinges upon the downstream inwardly extending tip of the damper 66D and provides an added closing force on the damper.

FIGS. 6, 7, and 8 are detail views illustrating other variations in construction which may be employed for the induction port damper 66. Thus, as shown in FIG. 6, with a vertically arranged damper 66E, the gravity opening bias can be enhanced by horizontally offsetting the pivot 68E. Also, if desired, as further illustrated in FIG. 6, an adjustable stop may be provided by means of a threaded thumb screw 110 which cooperates with the lower edge, or an extension of the lower edge, of the induction port damper 66E, as indicated at 112, to maintain the induction port damper 66E at a minimum open position in applications where some induction of secondary air is required at all times. It is obvious that the two different features of FIG. 6 may be separately applied to different damper designs.

FIG. 7 illustrates a detail view of another embodiment of the induction port damper which is identified at 66F, and having pivot 68F. In this embodiment, the gravitational opening bias, tending to rotate the damper clockwise is enhanced by a counterweight 114 which is adjustably attached to the damper 66F by means of a threaded post 116. The proportions of the counterweight 114 and post 116 with respect to the damper 66F are exaggerated in the drawing. The counterweight is normally much smaller in relation to the damper, and adjusted to be closer to the damper than is illustrated in the drawing. By adjusting the position of the counterweight 114, different initial opening biases may be selected for the damper.

FIG. 8 is another detail view of a further modification of the damper 66 as indicated at 66G. As shown in FIG. 8, it is not absolutely essential that the damper must be pivoted to swing about a central axis. Thus, it is possible to mount the damper for rotation about a pivot 68G which is at the upper edge of the damper structure, so long as an opening bias is provided. FIG. 8 illustrates another mode of biasing the damper towards the open position including an arm 118 attached to the damper, and a tension spring 120 attached from the end of the arm 118 to a fitting 122 which is fixed to the housing. Thus, the spring 120 provides the biasing force for opening the damper 66G in opposition to the force of primary air moving across the inside surface of the damper 66G.

It will be obvious that the counterweight device 114 of FIG. 7 could be alternatively used as the biasing device on the damper 66G of FIG. 8. Furthermore, the spring biasing device 120 of FIG. 8 could be alternatively employed with the damper structure of FIG. 7.

The tension spring bias device 120 of FIG. 8 provides a variable opening bias which is strongest when the damper valve element is closed, and which becomes progressively weaker as the damper opens. This is sometimes an advantage in achieving proportional operation, providing a selected gradient between primary and secondary air as the variable flow inlet 50 is opened.

It will be obvious that there are many other variations of the induction port damper valve element which may be employed. For instance, while the letter S cross-section configuration is preferred, the edge bends may be eliminated on either one or both edges to provide either an L-shaped configuration, or a flat damper configuration. Furthermore, the sealing and edge finishing devices 89 and 91 may be used with any of the damper configurations.

While the invention has been illustrated in combination with a double-throw linear diffuser in FIG. 1, with a diffuser having an outlet grille in FIG. 4, and with a troffer diffuser in FIG. 5, it will be apparent that the induction apparatus of the present invention may be used separately from a diffuser, or may be combined with any other known type of diffuser, such as a square diffuser, a round diffuser, a perforated diffuser, a grille, or a single slot linear diffuser.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

We claim:

1. An induction apparatus for a compressible fluid such as air as used in an air conditioning system and for mixing, by induced flow, primary fluid which may be conditioned with secondary fluid which may be unconditioned, comprising a housing having walls defining a compressible fluid inlet chamber and a separate compressible fluid outlet chamber and having a partition means between said chambers, said housing including means to connect said inlet chamber to a source of conditioned fluid and said housing also including an outlet to release fluid from said outlet chamber, said partition means including at least one constricted nozzle orifice for admitting compressible fluid from said inlet chamber to said outlet chamber, said partition means also including a variable flow fluid inlet positioned to one side of said nozzle orifice and adjacent to one outside wall of said housing, controllable means associated with said variable flow inlet for controllably varying the flow of primary fluid therethrough from said inlet chamber to said outlet chamber, an induction port opening in said wall of said housing in the portion thereof defining said outlet chamber, said induction port opening being arranged for communication with a source of secondary fluid, a damper valve element mounted within said induction port for closing said port and pivotally mounted to swing about an axis substantially perpendicular to the flow of fluid through said variable flow inlet, means for constantly biasing said induction port damper towards the open position, the pivotal mounting of said induction port damper being positioned so that the opening rotation of said induction port damper swings the downstream end of said damper into said outlet chamber of said housing and into the path of fluid from said variable flow inlet so that the flow of fluid from said variable flow inlet tends to close said damper, the opening and closing of said damper thus being controllable by the flow of fluid passing through said variable flow inlet to thereby control the volume of induced secondary fluid flow.

2. Apparatus as claimed in claim 1 wherein said variable flow inlet and said controllable means associated with said variable flow inlet and said induction port damper are positioned and arranged to provide for a direct flow of primary air from said variable flow inlet along the inside surface of said induction port damper whenever said variable flow inlet is opened by said controllable means.

3. Apparatus as claimed in claim 1 wherein said housing includes a constriction downstream from said induction port damper within said outlet chamber to provide a venturi action in entraining secondary fluid in the flow of primary fluid in order to enhance the induction effect.

4. Apparatus as claimed in claim 3 wherein said downstream constriction within said outlet chamber and said outlet to release fluid from said outlet chamber are combined to form in combination in said housing a diffuser structure for diffusing the released fluid into the conditioned space.

5. Apparatus as claimed in claim 4 wherein said housing and said inlet and outlet chambers and said variable flow inlet and said controllable means for controllably varying the flow of primary fluid through said variable flow inlet and said induction port and said damper valve element are all elongated in a dimension transverse to the general direction of fluid flow to thus provide a substantially long narrow apparatus with a long narrow diffuser outlet.

6. Apparatus as claimed in claim 4 wherein two separate downstream constrictions are provided within said outlet chamber for diffusing the released fluid into the conditioned space in at least two different directions for greater diffusion.

7. Apparatus as claimed in claim 1 wherein said controllable means associated with said variable flow inlet for controllably varying the flow of primary fluid therethrough from said inlet chamber to said outlet chamber comprises a pneumatically expansible oval casing device arranged within said variable flow inlet.

8. Apparatus as claimed in claim 1 wherein a plurality of variable flow fluid inlets are provided within said partition means between said inlet and outlet chambers each adjacent to one outside wall of said housing, and wherein separate controllable means are associated with each of said variable flow inlets, and wherein there is further provided an induction port opening and a damper valve element associated with each of said variable flow inlets and respectively controllable by said respective variable flow inlets by variation of the primary fluid flow therethrough.

9. Apparatus as claimed in claim 1 wherein said induction port damper valve element comprises a substantially rectangular structure elongated parallel to the pivot axis and wherein the pivot axis is substantially centered within said damper valve element so that part of said damper valve element swings into said housing and part of said damper valve element swings out of said housing during an opening movement thereof, the part of said damper valve element swinging into said housing comprising the downstream end of said damper valve element with respect to the flow of primary fluid.

10. Apparatus as claimed in claim 9 wherein said induction port is in a substantially vertical wall of said housing and said damper valve element is vertically arranged in the closed position, and wherein said means for constantly biasing said induction port damper towards the open position is combined in the structure of said damper valve element in the provision that the pivotal mounting of said damper valve element is horizontally offset towards the interior of said housing from the center of gravity of the main body of said damper valve element.

11. Apparatus as claimed in claim 9 wherein said induction port damper valve element has a cross section perpendicular to said pivot axis which is substantially shaped like a letter S.

12. Apparatus as claimed in claim 9 wherein said means for constantly biasing said induction port damper towards the open position comprises an offset of the pivotal mounting of said induction port damper with respect to the center of gravity of said damper to thereby provide a natural gravity bias towards the opening direction.

13. Apparatus as claimed in claim 1 wherein said means for constantly biasing said induction port damper towards the open position comprises a substantially horizontally extending arm attached to said damper valve element and including a weight adjustably positionable upon said arm for providing a gravity force bias upon said damper.

14. Apparatus as claimed in claim 1 wherein said means for constantly biasing said induction port damper comprises a spring device connected between said damper and said housing.

15. Apparatus as claimed in claim 1 wherein there is provided an adjustable stop member in the wall of said housing adjacent to said damper valve element for adjustably maintaining said damper valve element partially open when in the maximum closed position.

16. Apparatus as claimed in claim 1 wherein said damper valve element is pivotally mounted to said housing at the upstream edge thereof with respect to the normal direction of flow of primary fluid, and wherein said damper valve element is arranged to swing inwardly into said housing during opening movement thereof.

17. Apparatus as claimed in claim 16 wherein said induction port is positioned in an upper horizontal wall of said housing and wherein said means for constantly biasing said induction port damper towards the open position is provided by the weight of said damper valve element which tends to cause said damper valve element to drop by gravity force into the open position.

18. Apparatus as claimed in claim 16 wherein said means for constantly biasing said induction port damper towards the open position comprises a substantially horizontally extending arm attached to said damper valve element and including a wieght adjustably positionable upon said arm for providing a gravity force bias upon said damper.

19. Apparatus as claimed in claim 16 wherein said means for constantly biasing said induction port damper comprises a spring device connected between said damper and said housing.

* * * * *